United States Patent [19]

Shibata et al.

[11] 4,454,993

[45] Jun. 19, 1984

[54] GRINDER PUMP

[75] Inventors: Tomoyuki Shibata, Yokohama; Mituhito Nakayama, Fujisawa, both of Japan

[73] Assignee: Ebara Corporation, Tokyo, Japan

[21] Appl. No.: 342,408

[22] Filed: Jan. 25, 1982

[30] Foreign Application Priority Data

Aug. 29, 1981 [JP] Japan ..... 56-136004

[51] Int. Cl.[3] ..... B02C 23/36

[52] U.S. Cl. ..... 241/46 B; 241/46.08; 241/46.11

[58] Field of Search ..... 241/46 B, 46.06, 46.08, 241/46.11, 46.17

[56] References Cited

U.S. PATENT DOCUMENTS

| | | | |
|---|---|---|---|
| 3,650,481 | 3/1972 | Conery et al. | 241/46.11 |
| 3,961,758 | 6/1976 | Morgan | 241/46.11 |
| 4,108,386 | 8/1978 | Conery et al. | 241/46.11 |

*Primary Examiner*—Mark Rosenbaum
*Assistant Examiner*—Timothy V. Eley
*Attorney, Agent, or Firm*—Oblon, Fisher, Spivak, McClelland & Maier

[57] ABSTRACT

An improved grinder pump of the water immersed type is disclosed which includes a motor driven semi-open type pump impeller, a grinder ring fitted and firmly mounted in the suction port at the bottom of the pump casing, the grinder ring being provided with a plurality of axially extending grinding grooves and edges on the inner surface thereof, and a grinder impeller fixedly screwed on the distal end of the pump shaft to be coupled to the pump impeller in an end-to-end relation, the grinder impeller being provided with at least two axially extending grinding blades provided on the lower conical surface of the hub thereof so that any foreign material contained in the pumping liquid is ground or shredded into smaller pieces by cooperation of the grinding edges of the grinder ring with the grinding blades of the grinder impeller. A plurality of radially extending auxiliary blades are provided on the upper surface of the hub of the grinder impeller so as to perform additional pumping and grinding operation. The grinding blades protrude downwardly beyond the bottom of the grinder ring to provide the additional effect of ensuring to prevent foreign material in the pumping liquid from directly entering the grinding grooves from the suction port and foreign material is subjected to repeated shredding by the agitation of the grinding blades.

6 Claims, 7 Drawing Figures

GRINDER PUMP

BACKGROUND OF THE INVENTION

Field of the Invention

The present invention relates to a grinder pump of the water immersed type which functions both as pump and grinder for the purpose of pumping liquid and at the same time grinding or shredding foreign material contained in the flowing liquid.

As is well known, a grinder pump is provided with a grinding or shredding mechanism at the suction port of the pump or adjacent the pump impeller. As to the pump section various types of pumps such as vortex type pump, spiral type pump (semi-open type pump, closed type pump), snake type pump and others have been hitherto employed, whereas as to the grinding section both a single stage grinding mechanism and double stage grinding mechanism have been proposed and put in practical use.

One of the conventional spiral type pumps is disclosed in U.S. Pat. No. 3,961,758 assigned to Peabody Barnes Inc. In this prior invention the impeller is a semi-open type and the grinder is so constructed that foreign material is ground or shredded with the aid of a single stage grinding mechanism comprising a stationary cylinder and a rotary cylinder adapted to be rotated in said stationary cylinder together with grinding wheels while the pumped liquid containing foreign material therein passes through the space between the stationary cylinder and rotary cylinder. In this prior art, the shallow conical shaped impeller is short in axial length and, thus, in this type of a single stage, it is quite difficult to cut elongated foreign material such as polyvinyl chloride threads or the like entering the clearance and these foreign materials may clog the axial grooves serving as a cutter.

In another prior invention under U.S. Pat. No. 3,866,841 assigned to Elepon Technical Center Kabushiki Kaisha a submersible pump is disclosed which contains a single stage grinding structure comprising a closed type impeller. The grinding structure effects cutting and shearing by means of a combination of a stationary cutter and a rotary cutter arranged in horizontal planes, both cutters being relatively long.

U.S. Pat. No. 3,973,866 assigned to Vaughan Co., Inc. discloses a centrifugal slurry pump which comprises an impeller with wide blades serving also as cutter blades. In this slurry pump cutting or grinding is effected in the horizontal direction by means of the cutter in a single stage, while agitation is effected by means of agitating blades arranged in front of the suction port. However it has a drawback in that foreign material may clog the space between the suction port and pump impeller to block the rotation of the impeller.

Next, U.S. Pat. No. 3,417,929 discloses a comminuting pump which is provided with a single stage grinding mechanism comprising a plurality of spiral grinding blades which spirally extend in the axial direction as an extension of the impeller blades.

Now, a few examples of centrifugal pumps having a double grinding mechanism incorporated therein will be briefly described below.

In U.S. Pat. No. 3,650,481 assigned to Hydro-O-Matic Pump Co. a grinding pump is disclosed containing a semi-open type impeller. Due to the fact that the impeller blades of this pump are short, foreign material flown therethrough is cut to smaller size in both the vertical and horizontal directions so as to prevent any occurrence of clogging in the piping as well as in the impeller. Also agitating blades disposed before the cutter and axial blades disposed after the cutter improve the passage of foreign material. A similar grinding pump is disclosed in U.S. Pat. No. 3,726,486.

In U.S. Pat. No. 4,143,993 granted to A. Blum, grinding and cutting are effected in a different manner. Specifically, cutting is effected by means of a single cutter separately disposed below the impeller, while grinding is effected by means of the latter, the cutter and impeller being located in vertical alignment. The cutter contains a wave-shaped circular cutting edge therearound.

As described above, the conventional grinder pump is so constructed that the grinder section is located at the pump inlet and the rotary cutting blades are adapted to rotate inside of the stationary cutter so that pumped liquid containing foreign material to be treated passes therebetween. However it has been found with the conventional grinder pump that foreign material to be shredded, for instance, fibrous foreign material gets entangled in the clearance between the blades of the semi-open impeller and the casing end wall at the suction port or around the blades or the like and thereby clogging takes place, resulting in stoppage of rotation. In order to eliminate the drawback as described above a secondary grinding mechanism was introduced together with an agitating blade in front of the pump inlet. In case that the secondary grinding mechanism is provided, however, the cutter tends to jam easily.

Also, because the whole unit is complicated, further problems such as rotation blocking derived from the complicated structure, increased torque, time-consuming assembly and disassembly and other, arise. Further, since the agitating blade is separately disposed, it is possible that excessive scattering of foreign material may occur before it is to be cut in the grinder section.

In some case it happens that long and hard foreign material such as wire or the like clogs the vicinity of the cutter section in the grinder.

As is readily understood from the above description, the grinder pumps of the prior art are of various designs and each type has its inherent specific problems or drawbacks. They all have the common object of grinding or shredding foreign material included in the pumped liquid so the liquid will thereafter pass smoothly through the grinder pump unit, but it is natural that the characteristic features of the grinding mechanism should vary depending on the mechanical or physical properties of the foreign material to be treated.

SUMMARY OF THE INVENTION

Hence, it is an object of the present invention to provide an improved grinder pump which is well adapted to treat various kinds of foreign material contained in liquid to be pumped.

Agitating blades provided in this type of the pump agitate the liquid to be sucked to prevent foreign material contained therein such as wire-shaped hard material, large and solid foreign material, small ball-shaped high viscous greasy material or the like from directly entering into the grinding section. Further, it is preferable that the agitating blades be also effective in grinding or shredding foreign material in the flowing liquid. When the agitating blades effect excessively intense agitation, pump suction efficiency is substantially reduced. Thus, it is necessary to maintain a degree of agitation such that foreign material enters the grinding section at a proper rate. Thus, it is another object of the present invention to provide a grinder pump having agitating blades which allow foreign material to enter the grinding section at a proper rate.

It has been found, in a grinder pump equipped with a semi-open type impeller, that after foreign material leaves the grinding section it tends to stay where a cross-sectional flowing area is substantially varied behind the grinding section. More particularly, elongated and soft foreign material such as thread made of polyvinyl chloride which tends to be twisted after passing through the grinding section is apt to get entangled around the impeller hub having a reduced diameter or the blade tips resulting in reduced pump efficiency. Thus, another object of the present invention is to provide a grinder impeller which allows the impeller hub section to effect additional pumping and thereby energize the flowing liquid so as to prevent foreign material contained in the pumped liquid from being entangled about the coupling part intermediate the grinding section and impeller hub.

If the clearance between the blade ends of the impeller and the pump casing is small, solid foreign material tends to clog the clearance and further rotation of the impeller is prevented. On the other hand when fibrous foreign material gets entangled across the tips of two or more adjacent impeller blades, more driving power is required. Consequently, pump efficiency relative to rotational speed is reduced. If a conventional vortex pump is employed under the situation above, the result will be a reduced pump operating efficiency and high power consumption because of increased resistance in the grinding section. Thus, it is still another object of the present invention to provide a grinder pump having improved impeller action in which fibrous foreign material is not entangled between the impeller blade ends and pump casing or solid foreign material does not clog therein, without resulting in a reduced pump efficiency.

The above-mentioned objects are accomplished by a grinder pump according to the present invention.

The grinder pump of the present invention is constructed to include a pump impeller and a grinding impeller. The grinding impeller is mounted on a motor shaft and designed to have preferably two blades for effecting necessary agitation as well as cutting by the edges of the blades, the edges tracing a cylindrical surface upon rotation.

The blade of the grinding impeller is generally plate form and configured somewhat similar to a right-angled triangle comprising a vertical side extending along the cylindrical surface referred to above, an inclined side extending at a certain inclination toward the pump shaft and a truncated apex portion having a short side normal to the cylindrical surface. The above shaped rotary cutter blades are preferably formed on a lower surface of a shallow conical grinder hub. The greater part of the vertical side in the grinding impeller blade is disposed to oppose the inner cutting surface of a grinder ring stationarily mounted in the lower part of the pump casing with a close clearance therebetween to perform grinding operation.

The grinder ring is provided with a plurality of axial grooves on the inner surface so as to be indented therefrom. Each of the grooves is given sharp edges at the portions intersectioning with the inner surface of the ring so that the sharp edges coact with the grinding blades to cut the foreign material. These grooves also serve as passages for suctioning liquid containing the foreign material. The pump impeller is mounted adjacent the grinding impeller in abutting relationship therewith on the same shaft. The pump impeller is of a semi-open type and the open side thereof faces the suction port of the pump so that the pump impeller blades extend radially from the impeller boss as well as smoothly continue to the corresponding short blades radially extending from the boss disposed on the surface opposite the lower surface of the shallow conical hub of the grinding impeller. The axial edges of the short blades coincide with the cylindrical surface traced by the axial edges of the grinding blades.

The lower wall of the pump casing opposing the open side of the pump impeller is substantially flat except for the opening leading to the suction port and the distance between the lower wall and lower edges of the impeller blades is selected relative so that between the upper and lower casing walls to that the maximum pump efficiency is ensured. In determining the above distance it is taken into consideration that it prevents elongated foreign material such as thread-shaped material made of polyvinyl chloride, fibrous foreign material or the like from being entangled around the blade tips of the pump impeller and moreover it prevents solid foreign material from getting clogged between the lower casing wall and lower blade edges of the pump impeller.

The present invention will become more clear when the detailed description of the preferred embodiment is reviewed referring to the accompanying drawings the brief explanation of which is summarized below.

DETAILED DESCRIPTION OF THE PREFERRED EMBODIMENT

Now the present invention will be described in more detail with reference to the accompanying drawings.

Figure 1:
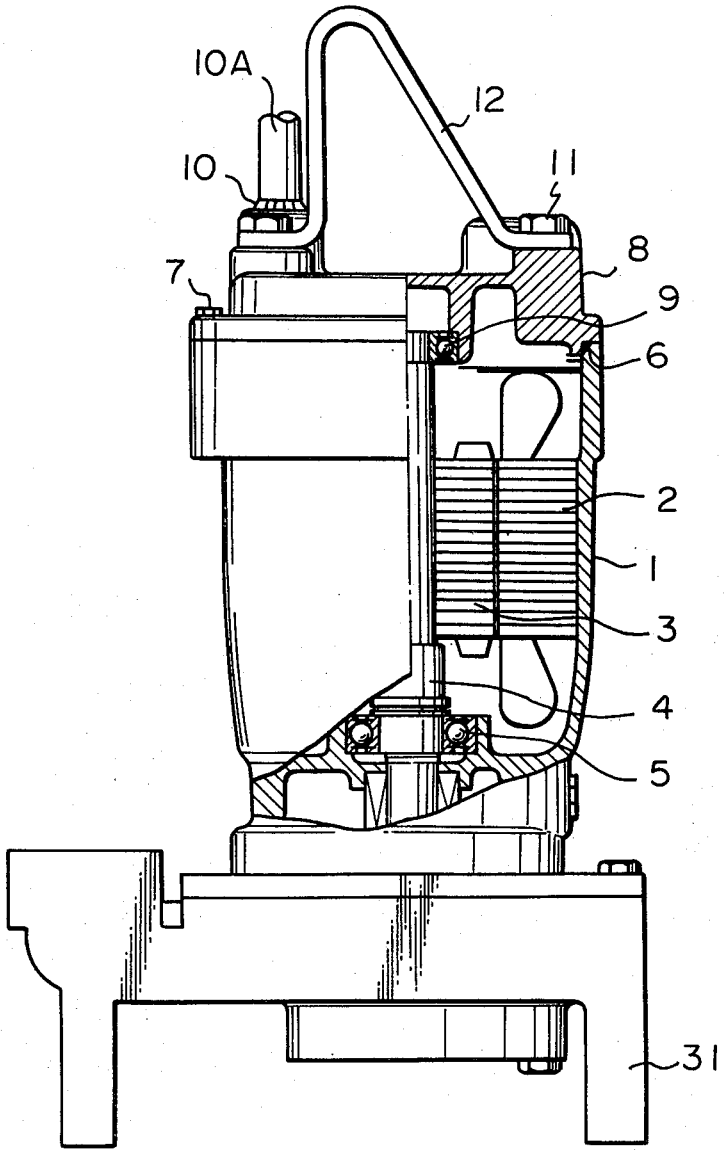
FIG. 1 is a partial sectional view of a grinder pump in accordance with a preferred embodiment of the present invention.

Referring to FIG. 1 which is a side view of a grinder pump in accordance with the present invention, reference numeral 1 designates a motor frame, reference numeral 2 a stator, and reference numeral 3 a rotor fixedly mounted on a pump shaft 4. The pump shaft 4 is rotatably supported by a lower bearing 5 fitted into a bearing housing integral with the motor frame 1 and an upper bearing 9 fitted into an end cover 8 firmly mounted on the motor frame 1 by means of bolts 7 with a seal ring 6 interposed therebetween and axial play of the pump shaft 4 is prevented by the bearings.

The end cover 8 is formed with a perforated boss into which a connector 10 is fitted so as to provide an electrical connection through the motor frame 1 without any possibility of causing leakage therefrom. A cable 10A extending from an outside power source is connected to the motor through the connector 10. The end cover 8 is also provided with a hanger 12 fixedly secured thereto by bolts 11 so that the whole pump assembly immersed in the water may be lifted up with the aid of a chain (not shown) connected to the hanger 12.

Figure 2:
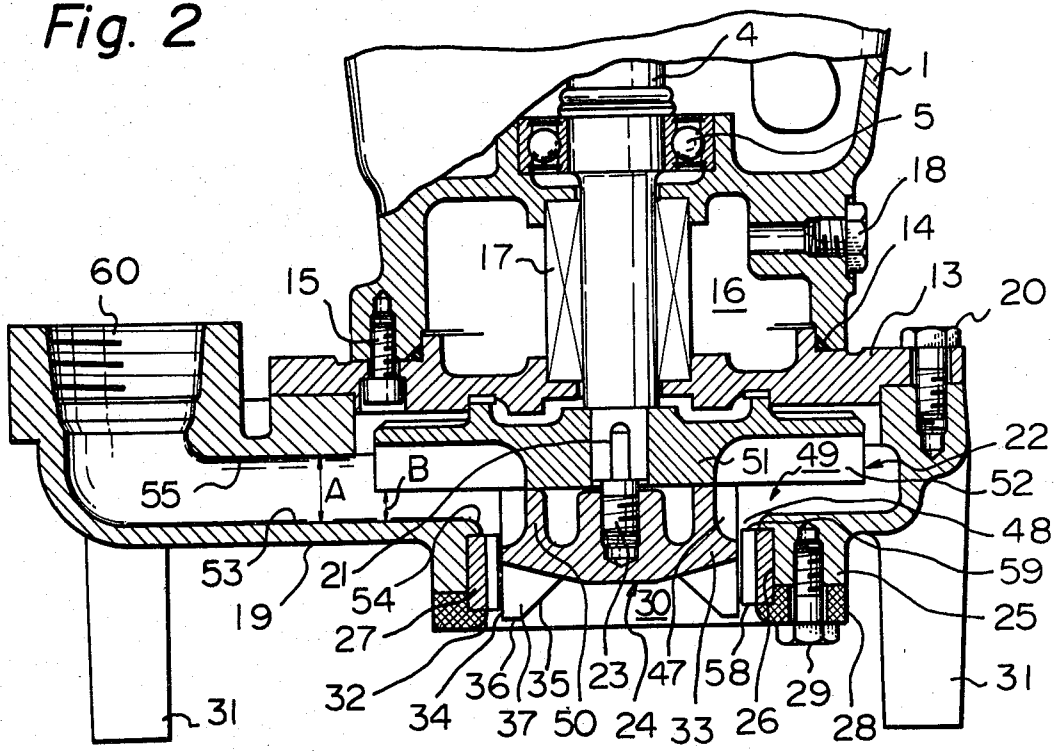
FIG. 2 is a vertical sectional view of the lower portion of the grinder pump in FIG. 1, shown in an enlarged scale.

Now, referring to FIG. 2, an intermediate casing 13 is fixedly secured to the bottom part of the motor frame 1 by bolts 15 with an O-ring 14 interposed therebetween, said bolts 15 extending through the intermediate casing 13 and being screwed into threaded holes in the motor casing 1. Between the motor frame 1 and the intermediate casing 13 is located a shaft sealing chamber 16 which ensures sealing for the pump shaft 4 with the aid of a shaft sealing mechanism 17 such as a mechanical seal or the like. Reference numeral 18 designates an inlet port through which lubricating and cooling medium is supplied to the shaft sealing chamber 16 so as to lubricate and cool the shaft sealing mechanism 17.

Further, the intermediate casing 13 is secured to a pump casing 19 by bolts 20 extending through holes of the intermediate casing 13 and being screwed into threaded holes on the pump casing 19.

At the lower part of the pump shaft 4 is disposed a pump impeller 22 which is adapted to rotate with the shaft 4 by way of a key 21. A grinder impeller 24 is mounted on the distal threaded end 23 of the shaft 4. The pump casing 19 is formed with a cylindrical boss 25 at the bottom part thereof which extends downwards to provide a stepped bore 26 into which a grinder ring 27 is press fitted so as not to be rotatable. Onto said grinder ring 27 is fitted and fixed a suction cover 28 by bolts 29 which extend through the suction cover 28 and are screwed into threaded holes on the pump casing 19. Further, in order to firmly support the whole grinder pump assembly and provide a suction passage between the bottom of the suction cover 28 and the bottom of a basin in which the pump assembly is immersed the pump casing 19 is provided with legs 31 which extend downward beyond the bottom of the suction cover 28.

To ensure smooth suction through the suction port 30, the suction cover 28 has a lower inner edge 32 which is rounded toward the suction passage. As is apparent from FIG. 2, the grinder impeller 24 is contained in the grinder ring 27 and the hub 33 of the grinder impeller is provided with a pair of oppositely located rotary blades 37 serving as cutters. The blade 37 is somewhat similar to a right angled triangle comprising an axial outer edge 34 and a diagonal edge 35 and an apex edge 36, the edge 34 tracing a cylindrical surface upon rotation of the grinder impeller 24. A part of the outer edge 34 is disposed to oppose the rounded part of the lower inner edge 32 of the suction cover 28 at the suction passage. Specifically, the rotary blades 37 protrude downward a little bit beyond the lower end of the grinder ring 27, while the lower end of the suction cover 28 is located below the lower end of the grinder ring 27, whereby it is ensured that clogging of the grooves of the grinder ring 27 with foreign materials is prevented. Otherwise such clogging may interfere with the rotation of the impeller. Also the rotary blades 37 are operated without any prevention of their rotation due to clogging of foreign materials in the grooves of the grinder ring 27, which will be described later. Since the rotary blades 37 have a plate-shaped configuration as illustrated in the drawing, they also function as an agitating blade.

Figure 3:
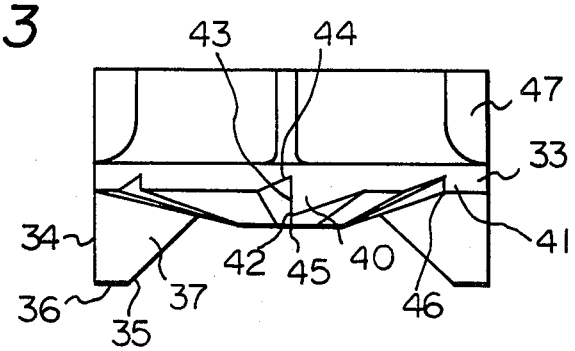
FIG. 3 is a side view of a grinder impeller incorporated in the grinder pump shown in FIGS. 1 and 2.
Figure 4:
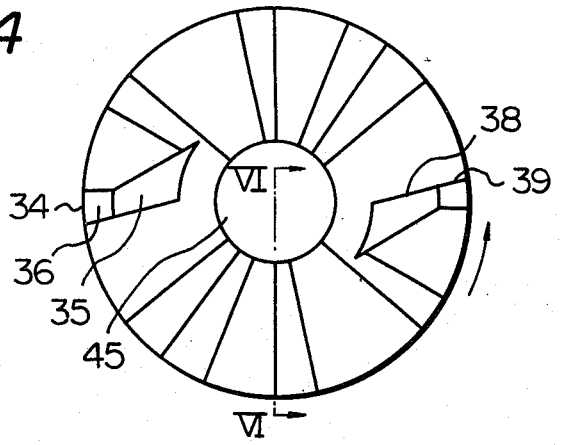
FIG. 4 is a bottom view of the grinder impeller shown in FIG. 3.

FIG. 3 is a side view of the grinder impeller, and FIG. 4 is a bottom view of the same. The grinder impeller 24 is designed to rotate in the direction as indicated by an arrow mark in FIG. 4. The outer end face or axial edge 34 of the rotary blade 37 traces, upon rotation of the grinder impeller, a cylindrical surface coinciding with the outer surface of the hub 33 and a cutting edge 39 is formed by the intersection of two faces, one of them being a scooping face 38 located at the forward side of the rotary blade 37 seen in the direction of the arrow mark, the other one being the outer end face 34 of the same. As is apparent from FIG. 4, an involving angle formed by the scooping face 38 and tangential face extending tangent to the outer end face 34 at the cutting edge 39 is smaller than 90 degrees. This geometrical configuration is referred to as a positive scooping angle in the present description. The diagonal edge 35 and the lower apex edge 36 are planar, however, the surface of the diagonal edge 35 may be made as a part of a rotary surface such as generated by rotation about the axis of the grinder impeller 24. Although the scooping angle at the cutting edge 39 is designed positive in the drawing, as mentioned above, it is preferable that the scooping angle be negative in case that hard foreign materials are included in the flowing liquid.

Figure 6:
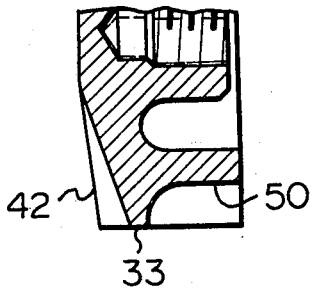
FIG. 6 is a partial sectional view of the grinder impeller taken along line VI—VI in FIG. 4.

The hub 33 of the grinder impeller 24 is provided with auxiliary cutter blades 40 and 41 extending radially on the conical bottom surface thereof. The cutting edge 42 of the auxiliary cutter blade 40 protrudes from the conical surface of the hub 33 and the scooping face 43 extends in the radial direction, substantially parallel to the axis of the impeller 24 and the cutter groove 44 is recessed on the conical bottom surface so that the depth of groove 44 is gradually reduced toward the apex so as to terminate at the circular boundary intermediate the bottom face 45 and the lower conical surface. The cutter groove of the auxiliary cutter blade 41 is the same as the cutter groove 44 of the auxiliary cutter blade 40 but it has a cutting edge 46 formed on the conical surface of the hub 33. As illustrated in FIG. 6, the cutting edge 42 of the auxiliary cutter 40 is inclined a little bit relative to the direction normal to the axis of the impeller axis.

Figure 5:
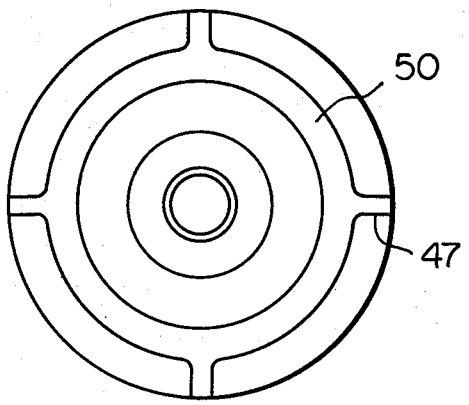
FIG. 5 is a plan view of the grinder impeller shown in FIG. 3.

As illustrated in FIG. 5, the grinder impeller 24 is further provided with auxiliary blades 47 on the hub 33 at the upper side opposite the blades 37. The auxiliary blades 47 also extend in the radial direction. The outer edge of the auxiliary blade 47 traces a cylindrical surface like that of edge 34 of the rotary blade 37. A part of the auxiliary blades 47 is disposed to oppose the inner wall of the grinder ring 27 so as to perform grinding operation in cooperation with the latter, while the other part of the edge of the blades 47 is exposed to the suction passage 48 and a volute chamber 49 surrounding the pump impeller 22. It is to be noted that the diameter at the part of the auxiliary blades 47 exposed to the suction passage 48 and the volute chamber 49 may be increased or decreased as necessary so that no fibrous material is entangled around this portion of the auxiliary blades which portion may serve as a pump blade. The hub 33 of the grinder impeller 24 has a cylindrical boss 50 from which the auxiliary blades 47 are extending in the radial direction. Whereas the impeller 22 has a cylindrical hub 51 which has the same outer diameter as that of the cylindrical boss 50. Thus both the boss 50 and the hub 51 come in contact with one another in an end-to-end relation in such a manner that their outer surfaces form a smooth and continuous contour.

The pump impeller is provided with a plurality of pump blades 52 extending radially from the hub 51. The number of pump blades is generally larger than that of the auxiliary blades 47; however, all the auxiliary blades are disposed so as to align with some of the pump blades 52 so that the surfaces of the blades 47 (except for outer edge surfaces) smoothly continue to the respective surfaces of the pump blades 52 thereby ensuring that liquid coming into the suction passage 48 does not stay there and moreover no fibrous material entangles around them.

The lower end wall 53 of the pump casing extends in a plane and the suction passage 48 is opened to this wall so as to communicate with the volute chamber 49. The corner edge of the suction passage 48 is rounded at 54 as illustrated. The lower end wall 53 of the pump casing is spaced from the open side lower edges of the blades 52 of the impeller 22 by distance B, as illustrated in FIG. 2. The distance B is determined so that the ratio of the distance B to the distance A between the lower end wall 53 and upper end wall 55 of the pump casing 19 is in the suitable range to ensure the maximum pump efficiency. In the case of the pump assembly as illustrated in the drawings it has been found that the maximum pump efficiency is obtained when the ratio B/A is in the range of 0.5 to 0.6. Further, it has been found that no substantial reduction in pump efficiency is recognized even when the ratio B/A is extended to within the range of 0.5 to 0.8.

Figure 7:
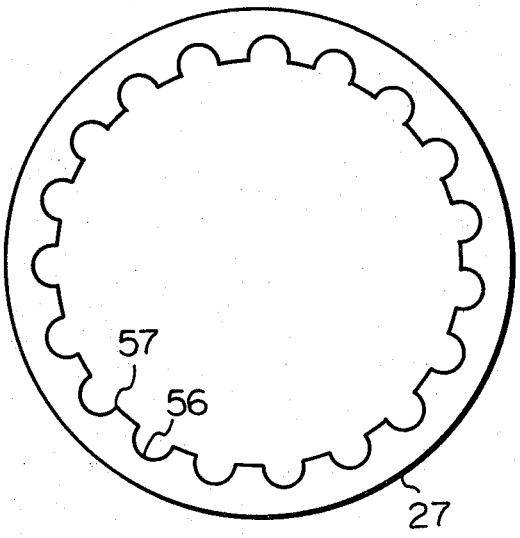
FIG. 7 is a plan view of a grinder ring.

FIG. 7 is a plan view of the grinder ring. The grinder ring 27 has a plurality of grinding grooves 56 recessed axially on the inner periphery. The grinding grooves 56 are designed in the form of an arc the center of which is located outward of the inner cylindrical wall surface of the grinder ring 56, whereby a positive scooping angle is given to each of the grinding edges 57. The grinding edges 57 extend between both the upper and lower end faces of the grinder ring 27 so that very sharp edges 58 and 59 are also provided at opposite ends of the grinding edges 57. The grinder ring 27 and grinder impeller 24 are arranged so that a relatively small clearance is kept between the inner cylindrical wall surface of the former and the outer periphery of the latter, so highly intensive grinding takes place by cooperation of the grinding edges 57 of the grinder ring 27 with the cutting edges 39 of the rotary blades 37. Also, outer tip edges of the auxiliary blades 47 effect the similar grinding function in cooperation with the grinding edges 57 of the grinder ring 27 at the portion where they are opposing each other. The suction cover 28 has an inner diameter which substantially coincides with a locus circle drawn by the bottom of the grooves 56.

It is to be noted that the grinder impeller 24 as well as the grinder ring 27 are made of ferrous material having high strength and hardness such as chromium molybdenum steel, high manganese steel or the like.

Now operation of the grinder pump of the invention will be described below. As the motor is energized and thereby the pump shaft 4 is driven, the pump impeller 22 is rotated and at the same time the grinder impeller 24 fixedly screwed on the distal end part 23 of the pump shaft 4 is rotated together with the impeller 22. It is arranged so that the grinder impeller 24 is not disconnected from the pump shaft 4 due to the rotation because the distal end part 23 of the shaft is given a screw thread tending to tighten the impeller by rotation of the pump shaft 4. Liquid to be pumped flows upward through the grinding grooves 56 of the grinder ring 27 by pumping operation of the pump impeller 22. Before entering the grooves 56, liquid passes between the rounded corner 32 of the suction cover 28 and the grinding edges 34 of the cutter blades 37 and also through the spaces between the cutter blades 37. Since the rotary blades 37 effect both pumping and agitating, foreign material in the mass having weak strength contained in the pumping liquid is easily broken down upon being struck by them. Further, since an eddy current is generated by the agitating function of the rotary blades 37, it is ensured that any rod-shaped foreign material contained in the pumped liquid is prevented from directly entering the grinding grooves 56 of the grinder ring 27 together with flowing liquid. Rather such elongated material approaches the grooves 56 at a certain angle of inclination. When foreign material carried by the flowing liquid enters the grinding grooves 56 and stays therein with a part of said foreign material protruding inwardly from the inner periphery of the grinder ring 27, it is subjected to shearing by cooperation of the cutting edges 39 of the cutter blades 37 with the grinding edges 57 of the grinder ring grooves 56. Sepcifically, when foreign material in the flowing liquid enters the grinding grooves 56 from the suction cover 28 and the lower end part of the grinder ring 27 and stays therein with a part of said foreign material protruding inwardly from the inner periphery of the grinder ring 27, it is thrust upward by means of the rotary cutting blades 37 and then is cut sharply by cooperation of the sharp corners at the upper and lower ends of the grinding edges 57 of the grinder ring 27 with the cutting edges 39 of the rotary cutting blades 37. Owing to the arrangement that the lower end part of the rotary blades 37 extends downwardly beyond the bottom face of the grinder ring 27, there is no possibility that foreign material contained in the pumping liquid will be thrust back from the grinding grooves 56 as is the case with the conventional arrangement in which the lower end part of the rotary blades 37 is located flush with the bottom face of the grinder ring 27.

The pumping liquid flows toward the grinding grooves 56 of the grinder ring 27, and at the suction port 30 swirls about an extension line of the pump shaft 4. The material contained in the axial flow toward the center of the grinder impeller 24 is broken by the cutting edges 42 and 46 of the auxiliary cutter blades 40 and 41. Foreign material in the pumped liquid flowing toward the grinding grooves 56 from the center portion of the grinder ring 27 is partly returned to the center portion by the rotation of the cutter blades 37 and thus is again introduced into the swirling liquid in the suction port 30. Thus, foreign material in the pumping liquid is given a chance to be repeatedly shredded by the agitation derived from the rotary cutter blades 37.

Accordingly, relatively large or long solid foreign material included in the pumping liquid is subjected to grinding and shredding when it collides with the cutting edges 42 and 46 of the auxiliary cutter blades 40 and 41, and when it collides with the rotary cutter blades 37 by cooperation of the cutting edges 39 of the rotary cutter blades 37 with the grinding edges 57 of the grinder ring 27.

As a result solid foreign material in the pumped liquid flowing through the grinding grooves 56 of the grinder ring 27 toward the pump impeller 22 becomes smaller in size than the cross-sectional dimensions of the grinding grooves 56, while long solid foreign material is cut to a shorter size. Long foreign material such as fiber, cord made of polyvinyl chloride or the like is also cut off by cooperation of the cutting edges 39 of the rotary cutter blades 37 and the grinding edges 57 of the grinder ring 27, because it is subjected to fluctuating movement due to the agitation of the rotary cutter blades 37. However it is to be noted that soft foreign material tends to be twisted like a thread, unless it flows through the grinding grooves 56 without any stay or rest. Foreign material leaves the grinding grooves 56 and enters the suction passage 48 together with the pumping liquid. As the suction passage 48 has a larger space above the grinder ring 27 between the ring 27 and the boss 50, the steaming speed of the pumping liquid is reduced. Since the auxiliary blades 47 are located at this spaced portion, foreign material which tends to stay there is subjected to shredding caused by cooperation of the rotating auxiliary blades 47 with the grinding edges 57 of the grinder ring 27. Further, the auxiliary blades 47 serve to energize the flowing liquid together with foreign material in the radial direction by way of their pumping function. Since the volute chamber 49 is so designed that the distance B is sufficiently wide and moreover solid foreign material in mass or solid long foreign material has already been broken to a certain smaller size, it flows together with the pumped liquid without being held or arrested in the space between the lower casing wall 53 and impeller 22. On the other hand, fibrous or thread-shaped foreign material is discharged together with the pumped liquid to the delivery port 60 through the volute chamber due to centrifugal force given by the swirling flow of the liquid generated by the auxiliary blades 47 and the pump impeller blades 52. The conventional grinder pump has a drawback in that long foreign material such as fibrous foreign material, thread-like foreign material or the like is apt to get entangled around the central part of the pump impeller. Since the grinder pump of the present invention is provided with auxiliary blades 47, it is ensured that any long and soft foreign material which tends to get entangled is thrown away outwardly of the pump impeller blades 52 without fail. This is attributable to the fact that the distance B is illustrated in FIG. 2 is less than that of the conventional vortex pump whereby generation of eddy current tending to be directed to the central portion is minimized at the open side of the pump impeller. While the flowing speed of pumped liquid may not be high, the centrifugal force of the auxiliary blades 47 assists such flow with an additional result that an increased suction is provided thereby. Further, since the lower casing wall 53 is designed to be planar, there is no danger of fibrous foreign material becoming entangled around projected parts raised from the lower casing wall 53 such as bosses or the like as is often the case with the conventional grinder pump.

The grinder pump in accordance with the present invention is so constructed that a grinder ring is fitted and fixed in a suction port of a pump casing which is in axial communication with a pump section, a large part of the grinder ring being located below the pump section, while a grinder impeller is arranged within the inner side of the grinder ring with a close clearance maintained therebetween, the grinder impeller being fixedly screwed on the lowermost end of a pump shaft extending downward to the suction port and comprising a conical hub which is additionaly provided with a plurality of radially extending auxiliary cutting edges. Therefore, it is ensured that foreign material included in the suction flow is cut into very fine pieces by the auxiliary cutting edges. Further, since the suction cover has a rounded corner 32 at the lower end of the inner peripheral edge thereof and rotary cutter blades are designed so that their lower end edge protrudes downward below the bottom face of the grinder ring, it is ensured that foreign material which moves toward the grinding grooves 56 and might clog the grooves is substantially prevented from entering thereinto.

The present invention has been explained in detail referring to the specific embodiment; however, it should be noted that further modifications and changes are readily available to those skilled in the art within the sprit and scope of the invention defined in the claims appended hereto.

What is claimed is:

1. A grinder pump including a casing having a pump chamber, a suction port communicating with said pump chamber and a discharge passage communicating with said pump chamber, a motor and a pump shaft operatively associated with said motor and extending axially through said pump chamber, comprising:

a semi-open type pump impeller disposed in said pump chamber and including a pump impeller hub adapted to cooperate with said pump shaft for mounting said pump impeller thereon, said pump impeller further comprising a plurality of pump impeller blades extending radially from said pump impeller hub and each said plurality of pump impeller blades having an open side edge facing said suction port and wherein said open side edges of said plurality of pump impeller blades are positioned a predetermined distance above a lower end wall of said discharge passage so as to maintain a desired pump efficiency;

a grinder ring mounted in said suction port coaxially with said pump shaft and wherein said grinder ring further comprises a plurality of axially extending grinding grooves and a plurality of axially extending grinding edges on an inner surface thereof;

a grinder impeller mounted on an end of said pump shaft distal said motor and positioned adjacent said pump impeller, said grinder impeller further comprising a grinder impeller hub facing said suction port and at least two grinding blades disposed on said grinder impeller hub, each of said at least two grinding blades having a sharp axial edge defining a cylindrical surface of revolution when said grinder impeller is rotated and wherein said cylindrical surface of revolution and said inner surface of said grinder ring define a small, predetermined clearance therebetween such that said plurality of axially extending grinding edges and said at least two grinding blades cooperate to effect shredding therebetween and further wherein a diameter of said grinder impeller hub is substantially equivalent to a diameter of said cylindrical surface of revolution;

a boss formed on said grinder impeller hub on a side opposite said at least two grinding blades and disposed to abut against said pump impeller hub such that an outer surface of said boss is smoothly continguous with an outer surface of said pump impeller hub to form a smooth continuous outer surface to prevent clogging of said grinder pump; and a plurality of auxiliary blades formed on said boss of said grinder impeller hub, each of said plurality of auxiliary blades having a radial end disposed substantially on said cylindrical surface of revolution and wherein each of said plurality of auxiliary blades forms a continuous axial surface with a corresponding one of said plurality of pump impeller blades to prevent clogging of said grinder pump.

2. The grinder pump as claimed in claim 1 wherein each of said plurality of auxiliary blades further comprises an axially extending portion of said radial end disposed in opposed relation to said inner surface of said grinder ring such that said axially extending portion of said plurality of auxiliary blades and said plurality of axially extending grinding edges cooperate to effect shredding therebetween.

3. The grinder pump as claimed in claim 2 wherein said grinder impeller hub further comprises a shallow conical surface facing said suction port and having a plurality of radial cutting edges formed thereon.

4. The grinder pump as claimed in claim 1 or 2 or 3 further comprising a suction cover ring covering a lower axial end of said grinder ring and wherein an inside surface of said suction cover ring coincides with a phantom circle defined by an innermost recessed point of each of said plurality of axially extending grinding grooves and a lower internal edge of said suction cover ring facing said suction port is rounded.

5. The grinder pump as claimed in claim 1 or 2 or 3 wherein said predetermined distance further comprises about 50 to 80% of a distance between said lower end wall and an upper end wall of said discharge passage.

6. The grinder pump as claimed in claim 1 wherein each of said at least two grinding blades further comprises a lower end extending axially beyond a lower end surface of said grinder ring such that clogging of said plurality of axially extending grinding grooves is prevented.

* * * * *